United States Patent [19]

Okada et al.

[11] Patent Number: 4,565,436

[45] Date of Patent: Jan. 21, 1986

[54] ELECTROPHOTOGRAPHIC COPYING PROCESS

[75] Inventors: Takao Okada; Akitoshi Toda; Yoshiyuki Mimura, all of Hachioji, Japan

[73] Assignee: Olympus Optical Co., Ltd., Tokyo, Japan

[21] Appl. No.: 549,314

[22] Filed: Nov. 7, 1983

[30] Foreign Application Priority Data

Nov. 27, 1982 [JP] Japan ..... 57-208311

[51] Int. Cl.[4] ..... G03G 15/22

[52] U.S. Cl. ..... 355/3 R; 355/3 CH; 355/14 CH; 430/55; 361/229

[58] Field of Search ..... 355/3 R, 3 CH, 14 CH; 250/324–326; 361/229, 235, 225; 430/54, 55, 902

[56] References Cited

U.S. PATENT DOCUMENTS 3,775,104 11/1973 Matsumoto et al. ..... 355/3 R X
4,038,593 7/1977 Quinn ..... 361/225 X

FOREIGN PATENT DOCUMENTS 47-269117 7/1972 Japan .
54-36498 11/1979 Japan .

*Primary Examiner*—A. T. Grimley
*Assistant Examiner*—J. Pendegrass
*Attorney, Agent, or Firm*—Louis Weinstein

[57] ABSTRACT

An electrophotographic process and apparatus for performing the process which employs an electrophotographic photosensitive member of a basic construction in which a photoconductive layer and a transparent insulator layer are sequentially laminated on the surface of a conductive supporter. The process comprises a first step of providing a primary charge uniformly from the surface side of the transparent insulator layer, a second step of performing a secondary corona charging during an imagewise exposure by applying a square wave voltage whose voltage-time integration value of a polarity reverse to the primary charge is larger than that of the same polarity thereas and a third step of forming an electrostatic latent image on the surface of the transparent insulator layer by applying a uniform exposure.

11 Claims, 20 Drawing Figures

FIG. 1 (II)

FIG. 1 (III)

FIG. 7 (II)

FIG. 7 (III)

ELECTROPHOTOGRAPHIC COPYING PROCESS

BACKGROUND OF THE INVENTION

The present invention relates to an electrophotographic copying process apparatus, and more particularly, to such a process and apparatus for performing the process for forming an electrostatic latent image of a high contrast voltage on an electrophotographic photosensitive member.

It is well known in the art that an electrophotographic photosensitive member has a basic construction including a conductive supporter, a photoconductive layer and a transparent insulator layer in sequentially laminated relationship. By way of example, an electrophotographic process for forming an electrostatic latent image on the photosensitive member has been known in which after a primary charging, a secondary corona charging is provided by a sinusoidal wave a.c. corona discharging during an imagewise exposure and subsequently a uniform exposure is applied to form an electrostatic latent image (Japanese Patent Publication No. Sho 42-23910).

However, the above electrophotographic process of the prior art, in which a secondary corona charging is effected by a sinusoidal wave a.c. corona discharging, has the characteristics of the corona discharging in that even if a positive and a negative voltage-time integration value of a sinusoidal wave alternate current applied to a corona charger are equal, the negative corona charging is more easily effected than the positive one, resulting in that the charging is apt to incline toward the negative side. Accordingly, in the case that an electrophotographic photosensitive member includes a photoconductive layer of the p-type, for example, when an electrostatic latent image is formed according to the above-mentioned electrophotographic process to provide a negative charge as a primary charge, to apply a sinusoidal wave a.c. corona charging as a secondary charge simultaneously with an imagewise exposure and subsequently to provide a uniform exposure, it is difficult sufficiently to neutralize and release a negative charge at a bright area of the latent image and to obtain a sufficient contrast voltage between a bright and a dark area thereof, indicating a negative value of a potential level at the bright area (−100 to −600 V). When the latent image is developed with a positive toner, it disadvantageously shows a photographic fog at the bright area.

To eliminate the above disadvantage, a process such as shown in Japanese Patent Publication No. Sho 47-26911 has already been proposed in which a secondary corona charging is provided by superposing a d.c. voltage on a sinusoidal wave a.c. voltage. With the process, a voltage-time integration value of one polarity of the a.c. voltage to be applied to a corona charger is made larger than that of the other polarity to improve the corona discharging characteristics to a desired one and a voltage level at the bright area after formation of an electrostatic latent image is controlled to a value close to zero volts. Since the voltage level at the bright area becomes substantially zero volts, the possibility of causing a photographic fog at the bright area is advantageously reduced.

However, with this process, in which a corona discharging is effected employing a sinusoidal wave a.c. voltage changing every moment, it is considered that an ion current density and a kind of ions vary as time goes, since a state not provided with a.c. discharge is caused with a certain polarity and within a certain range of voltage below a discharge initiation voltage or a corona discharge current varies every moment. Accordingly, although the presence of a corona discharge, an ion current density and a kind of ions are very important factors to the formation of an electrostatic latent image, there may be caused the trouble that these factors are not necessarily predetermined ones. This trouble may cause the stability of an image quality to be easily impaired and this is a large problem especially under an environment of high humidity. Specifically, with this process, a corona discharging becomes unstable and hence there is a great possibility that the stability and the uniformity of a potential level may not be sufficiently maintained.

SUMMARY OF THE INVENTION

In view of the foregoing, it is an object of the invention to provide a novel electrophotographic process and apparatus for performing the process in which a secondary corona charging is effected with a square wave voltage whose voltage-time integration value of a polarity reverse to a primary charge is higher than that of the same polarity thereas.

According to the invention, since a quantity of corona ions of the polarity reverse to the primary charge increases during the secondary corona charging, it is possible to emphasize the reverse polarity to the primary charge. Accordingly, potential levels at a bright and a dark area of an electrostatic latent image can be established at a predetermined level by adjusting an amplitude and an energization period of the square wave voltage. As a result, it is possible to obtain an electrostatic latent image with a high contrast, the possibility of causing a photographic fog being reduced.

Furthermore, since the secondary corona charging is effected applying the square wave voltage, a non-discharging period (the period from the time a voltage falls to its discharge termination voltage to the time a voltage rises to its discharge initiation voltage) such as in the case that a conventional sinusoidal wave a.c. voltage is employed is substantially eliminated and a corona ion density and a kind of ions during a discharging period with a certain polarity is maintained constant, resulting in uniform and stable charging. As a result, it is possible to obtain a uniform and stable electrostatic latent image and particularly such a latent image of a high contrast that a photographic fog is unlikely to occur even in the presence of high humidity.

Additionally, it is possible to obtain an electrostatic latent image having little influence of a frequency response by adjusting a frequency in accordance with a process speed of charging and exposure.

DESCRIPTION OF THE PREFERRED EMBODIMENTS

Figure 1:
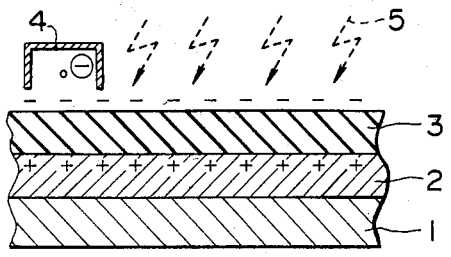
FIGS. 1 (I) to (III) are process diagrams respectively illustrating sequential steps in an electrophotographic process of an embodiment according to the invention.
Figure 1:
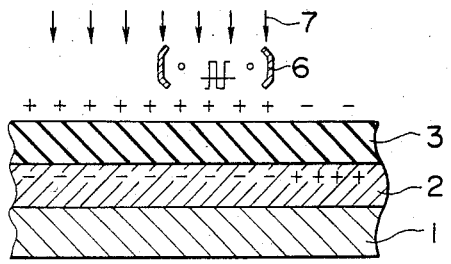
Figure 1:
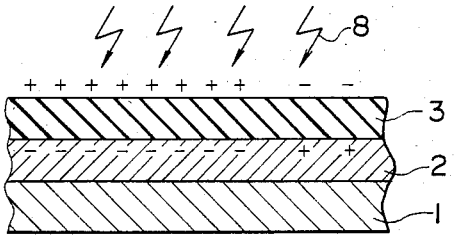

Referring to FIGS. 1 (I) to (III), an electrophotographic photosensitive member to which an electrophotographic process of one embodiment of the invention is applied has a basic construction in which a photoconductive layer 2 and a transparent insulator layer 3 are sequentially laminated on the surface of a conductive supporter 1. The conductive supporter 1 is formed of a conductive material such as Al, Ag, Cu, Ni, Cr, or it may be such a composite member as a conductive layer is coated on the surface of a non-conductive substrate. The photoconductive layer 2 is formed of an inorganic photoconductive material such as Se, Se-Te, Se-Te-As, CdS, ZnO, PbO or an organic photoconductive material such as Polyvinylcarbazole PVK, Trinitrofluorenone TNF or the like. The transparent insulator layer 3 is formed by coating Polyethylene terephthalate, Teflon or the like or by a gaseous phase vaporization method of Paraxylylene or by applying and then drying Epoxy resin, Urethane resin, Acrylic resin, Polyester resin, Alkyd resin or the like.

A first step of an electrophotographic process of the embodiment, as shown in FIG. 1 (I), is a primary charging process in which when the photoconductive layer 2 is of the p-type a negative d.c. high voltage is applied to a corona charger 4 to charge the surface of insulator layer 3 uniformly with negative charge. As a result, a pair of positive and negative charges are uniformly formed on both side surfaces of the insulator layer 3. It is to be noted that there are cases where charge is not sufficiently injected from the conductive supporter 1 side to the photoconductive layer 2 during the primary charging depending upon the kind employed for materials of photoconductive layer 2 and conductive supporter 1. In such a case, it is possible that the primary charging is performed more effectively by uniform irradiation of light 5 in concurrence with or after the corona charging, as shown in FIG. 1 (I) with dotted lines.

Figure 2:
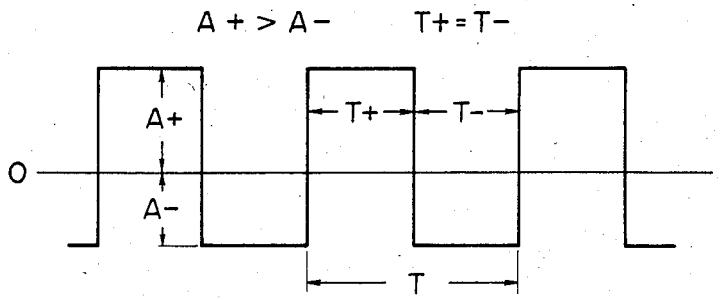
FIG. 2 is a wave form diagram illustrating a square wave voltage for use in the second step shown in FIG. 1 (II)

A second step, which is a step of a secondary corona charging in concurrence with an imagewise exposure, a corona discharging in the case of the embodiment in which a polarity of the primary charge is negative is performed with a corona charger 6 to which a square wave voltage is applied, in concurrence with an imagewise exposure 7, as shown in FIG. 1 (II). The square wave voltage, as shown in FIG. 2, is such that its positive amplitude A+ (absolute value) is larger than its negative amplitude A− (absolute value) and its positive and negative energization periods T+, T− during one period T are equal. It is to be noted that amplitudes A+, A− are larger than a discharge initiation voltage of the corona charger 6. With the secondary corona charging in concurrence with the imagewise exposure, surface charge of the insulator layer 3 at a bright area of the imagewise exposure 7 is removed and carriers are produced within the photoconductive layer 2 by the light. Accordingly, positive charge which has been produced on the reverse side of the insulator layer 3 after the primary charging is neutralized and released. In addition, since the square wave voltage whose positive voltage-time integration value is larger than its negative one is being applied to the secondary corona charger 6, the charge on the surface of the insulator layer 3 is not only removed but also made positively to substantially zero volts, reversing the polarity of the primary corona charge. At this time, as the light is applied a pair of positive and negative charges are formed with the insulator layer 3 between in the same manner as in the previous primary charging. At a dark area of the imagewise exposure 7 where light is not irradiated, positive charge which is held on the photoconductive layer 2 of the insulator layer 3 side is retained without being neutralized and released.

In a third step, as shown in FIG. 1 (III), a uniform exposure is performed by light 8 from the surface side of the insulator layer 3. With the uniform exposure of light 8, charge other than the surface charge of the insulator layer 3, and the surface charge of the photoconductive layer 2 of the insulator layer 3 side which surface charge corresponds to the surface charge of insulator layer 3 is extinguished at the dark area of the imagewise exposure. At the bright area, no movement of charge occurs. Thus, an electrostatic latent image in which its bright area has positive charge and its dark area has negative charge is formed on the surface of insulator layer 3.

As described above, with the electrophotographic process of the first embodiment according to the invention, in which photoconductive layer 2 is of the p-type, a secondary corona charging is performed employing a square wave voltage whose positive amplitude A+ of a polarity reverse to the primary charge is larger than its negative amplitude A− of the same polarity as the primary charge and its positive and negative energization periods T+, T− are equal. Accordingly, corona ions of the a polarity reverse that of the primary charge are released much more than ions of the same polarity as the primary charge and an electrostatic latent image of a high contrast voltage which emphasizes the reverse polarity to the primary charge can be formed.

In addition, since the square wave voltage, unlike a sinusoidal wave voltage, is such that its amplitudes A+, A− are set to higher values than a discharge initiation voltage, the rise of a corona discharging is rapid, resulting in stable discharging. Thus, it is possible to form a uniform and stable electrostatic latent image.

It is to be noted that frequencies of 50 to 1,000 Hz are most suitable for the square wave voltage. The frequency is selected in accordance with a process speed of charging or exposure. For example, if a higher frequency zone is selected, the processing speed can be increased.

Figure 3:
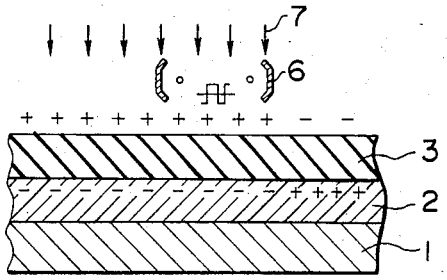
FIG. 3 is a process diagram illustrating the second step in an electrophotographic process of another embodiment according to the invention.
Figure 4:
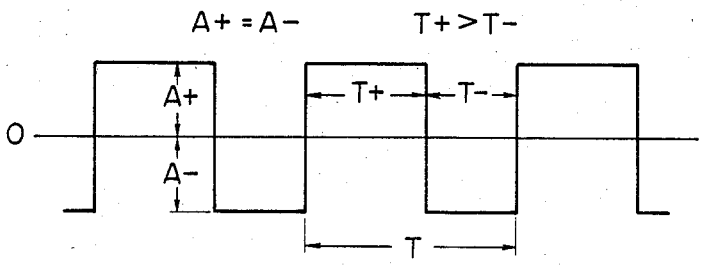
FIG. 4 is a wave form diagram illustrating a square wave voltage for use in the second step shown in FIG. 3.

FIG. 3 shows a second step in an electrophotographic process illustrating another embodiment of the invention. In the process of the first embodiment shown in FIGS. 1 (I) to (III), the square wave voltage for the secondary corona charging is such that its positive amplitude A+ is larger than its negative amplitude A−. However, if a positive and a negative amplitude A+, A− are made equal, it would be in a better result. To this end, a process of the second embodiment shown in FIG. 3 employs a square wave voltage for a secondary corona discharging whose positive and negative amplitudes A+, A− are equal and its positive energization period T+ is longer than its negative energization period T− during one period T, as shown in FIG. 4, so that substantially the same effect as in the process of the first embodiment shown in FIGS. 1 (I) to (III) may be obtained. Specifically, when the photoconductive layer 2 is of the p-type, a positive and a negative amplitude A+, A− are made equal and the relation of a positive and a negative energization period T+, T− during one period T is made to satisfy an inequality of $T+>T-$ so that a quantity of positive corona ions can be increased without deteriorating the stability of discharging. Thus, a potential level during the secondary corona charging can be brought close to zero or its neighborhood and a potential on the bright area of the latent image can be made equal to that of a polarity reverse that of the primary charge.

Figure 5:
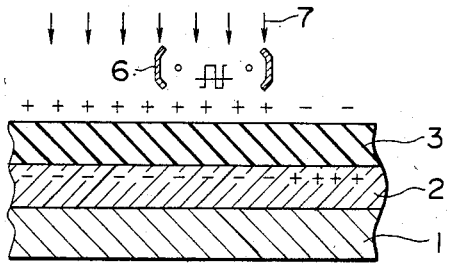
FIG. 5 is a process diagram illustrating the second step in an electrophotographic process of a further embodiment according to the invention.
Figure 6:
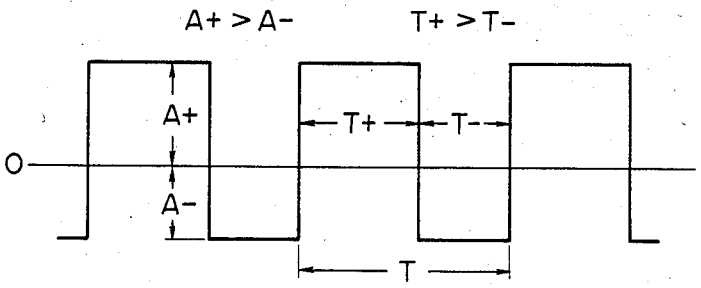
FIG. 6 is a wave form diagram illustrating a square wave voltage for use in the second step shown in FIG. 5.

In FIG. 5, which shows a secondary step in an electrophotographic process of a further embodiment according to the invention, the process employs a square wave voltage for a secondary corona charging whose positive amplitude A+ is larger than its negative amplitude A− and its positive energization period T+ is longer than its negative one T− during one period T, as shown in FIG. 6.

According to the process, it is to be noted that the same effects as processes in the first and second embodiments shown in FIGS. 1 (I) to (III) and FIG. 3 can be obtained by properly adjusting the positive and negative amplitudes A+, A− as well as the positive and negative energization periods T+, T−.

Figure 7:
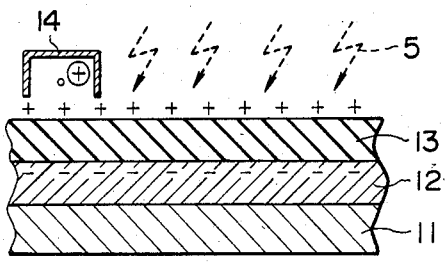
FIGS. 7 (I) to (III) are diagrams respectively illustrating sequential steps in an electrophotographic process of a still further embodiment according to the invention.
Figure 7:
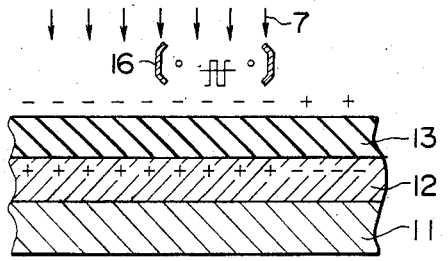
Figure 7:
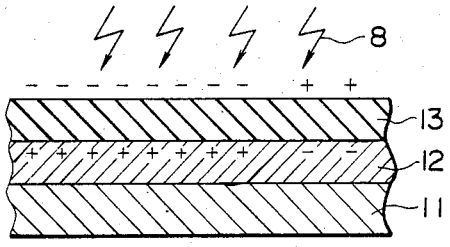

FIGS. 7 (I) to (III) show sequential steps in an electrophotographic process of a still further embodiment according to the invention when a photoconductive layer of an electrophotographic photosensitive member is of the n-type. The photosensitive member has a basic construction in which a photoconductive layer 12 of the n-type and a transparent insulator layer 13 are sequentially laminated on the surface of a conductive supporter 11. The supporter 11, photoconductive layer 12 and transparent insulator layer 13 are formed with the same materials as those of corresponding members of the first embodiment shown in FIGS. 1 (I) to (III).

In a first step of the process, as shown in FIG. 7 (I), a positive high d.c. voltage is applied to a corona charger 14 to provide positive charge uniformly on the surface of insulator layer 13. Similar to the step shown in FIG. 1 (I), a primary charging in combination with a uniform exposure of light 5 may be performed more effectively.

Figure 8:
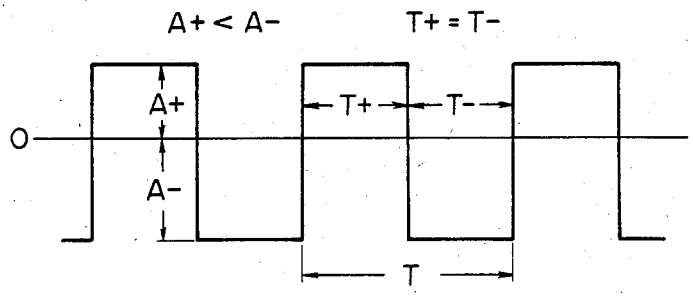
FIG. 8 is a wave form diagram illustrating a square wave voltage for use in the second step shown in FIG. 7 (III)

In a second step, as shown in FIG. 7 (II), a corona discharging is performed by applying a square wave voltage as shown in FIG. 8 to a corona charger 16 during an imagewise exposure 7. Since the primary charge is positive, the square wave voltage is set so that its positive amplitude A+ is smaller than its negative amplitude A− and its positive and negative energization periods T+, T− during one period T are equal.

In a third step, as shown in FIG. 7 (III), a uniform irradiation of light 8 is applied from the surface side of the insulator layer 13 to form an electrostatic latent image where its bright area is negative and its dark area is positive. According to this process, it is to be noted that effects similar to those of the process in the first embodiment shown in FIGS. 1 (I) to (III) are obtainable except that polarities of an electrophotographic photosensitive member to be applied are reversed.

Figure 9:
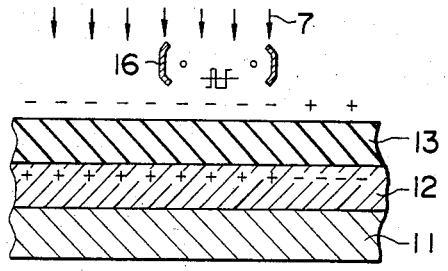
FIG. 9 is a process diagram illustrating the second step in an electrophotographic process of an additional embodiment according to the invention.
Figure 10:
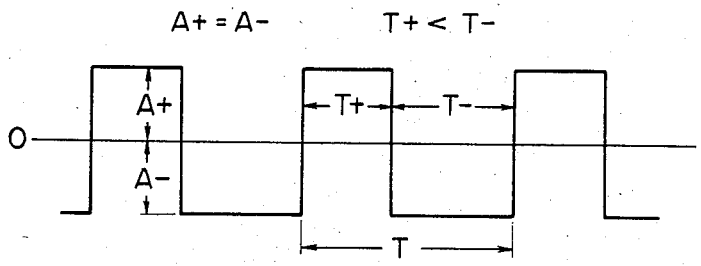
FIG. 10 is a wave form diagram illustrating a square wave voltage for use in the second step shown in FIG. 9.

FIG. 9 shows a second step in an electrophotographic process of an additional embodiment when a photoconductive layer of the photosensitive member is of the n-type. The process in FIG. 9, as shown in FIG. 10, employs a square wave voltage for a secondary corona charging whose positive and negative amplitudes A+, A− are equal and its positive energization period T+ is shorter than its negative period T− during its period T. The process corresponds to the one shown in FIG. 3 in which the photoconductive layer is of the p-type and provides effects similar to the process of the second embodiment shown in FIG. 3 except that polarities of the photosensitive member to be applied are reversed.

Figure 11:
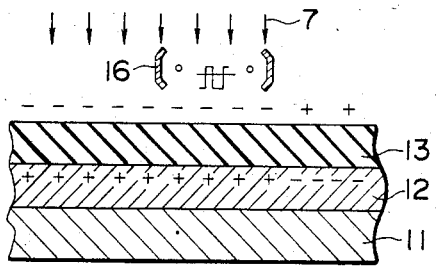
FIG. 11 is a process diagram illustrating the second step of still another embodiment according to the invention.
Figure 12:
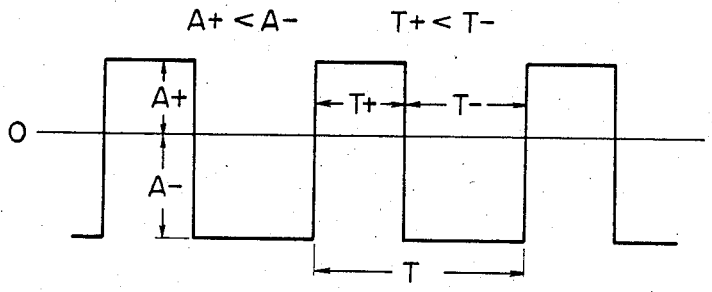
FIG. 12 is a wave form diagram illustrating a square wave voltage for use in the second step shown in FIG. 11.

FIG. 11 shows a second step in a process of an still another embodiment in which a photoconductive layer is of the n-type. In the process, as shown in FIG. 12, a secondary corona charging is performed employing a square wave voltage whose positive amplitude A+ is smaller than its negative amplitude A− and its positive energization period T+ is shorter than its negative period T−. This process corresponds to the one shown in FIG. 5 and provides effects similar to those of the process shown in FIG. 5 except that polarities of the photosensitive member to which the process is applied are reversed.

Figure 13:
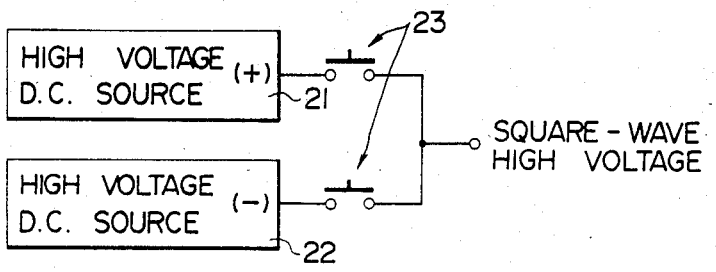
FIG. 13 is a schematic diagram illustrating one example of means for generating a square wave voltage for use in the process of the invention.

FIG. 13 shows an example of means for generating a square wave voltage which is applied to the corona charger 6, 16. The means need a high voltage of the order of several kV to ten kV to perform a corona discharging. In the means of FIG. 13, a square wave high voltage is generated employing a positive and a negative high voltage d.c. source 21, 22 and a high voltage lead relay 23. Specifically, output terminals of d.c. sources 21, 22 are connected to input terminals of a pair of lead relays 23 and the other terminals of relays 23 are connected together to a terminal for a square wave voltage output so that a square wave voltage having a desired wave form can be obtained setting the ratio T+/T− of energization periods T+, T− to a predetermined value by causing lead relays 23 to turn on or off alternately.

Figure 14:
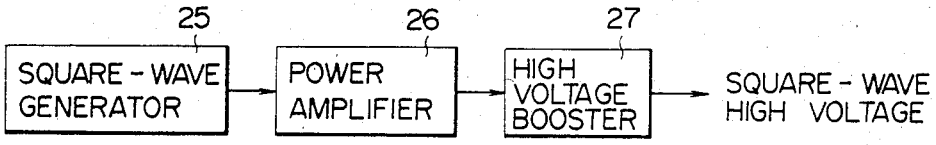
FIG. 14 is a schematic diagram illustrating another example of means for generating a square wave voltage for use in the process of the invention.

FIG. 14 shows another example of means for generating a square wave high voltage. The means of FIG. 14 generates a square wave having a predetermined wave form with a square wave generating circuit 25, amplifies it through a power amplifier circuit 26 and subsequently applies the amplified wave to a high voltage booster 27 to obtain an intended square wave high voltage. In this case, the booster 27 requires to be in conformity with a frequency of the square wave.

Figure 15:
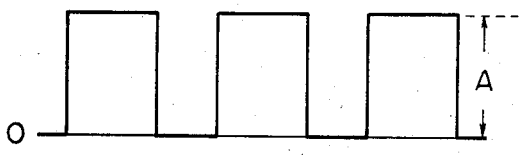
FIGS. 15 (*a*) and (*b*) are sequential wave form diagrams illustrating a further example of means for generating a square wave voltage for use in the process of the invention.
Figure 15:
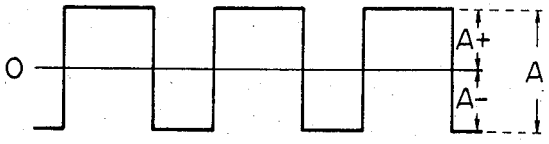

FIGS. 15 (*a*) and (*b*) show an example of a method for generating a square wave high voltage. In this method, a d.c. high voltage is turned on and off by a signal from a pulse generator (not shown) or the like and an output thus obtained as shown in FIG. 15 (*a*) is superposed with a predetermined negative d.c. voltage to obtain a square wave high voltage as shown in FIG. 15 (*b*). For example, when a positive and a negative amplitude A+, A− are equal and the d.c. high voltage is A, the negative d.c. voltage to be superposed may be as follows:

$$Va = -\frac{A}{2} = \frac{A+ + A-}{2} = -A+$$

An experimental example to which the electrophotographic process of the invention was applied will be given together with definite numeral values as follows.

The photoconductive layer 2 was formed by sequentially applying a charge transport layer which is formed by vacuum evaporation of selenium Se and a charge generating layer which is formed by vacuum evaporation of selenium Se and tellurium Te on the surface of conductive supporter 1 of nickel Ni. Additionally, the electrophotographic photosensitive member was provided which is formed with the transparent insulator layer 3 by gaseous phase evaporation of paraxylylene on the photoconductive layer 2. Subsequently, the photosensitive member was left under the surroundings of temperature 25° C. and humidity 60%. Then, after being charged to −2,000 V with a Scorotron charger 4 as a primary charge, the member was provided with a secondary charge of a corona discharging by applying a square wave voltage which has A+=A−=4.2 kV, T+/T−=65/35 and a frequency 200 Hz and which is from the means for generating a square wave high voltage as shown in FIG. 14, to a corona charger 6, in concurrence with the imagewise exposure. Subsequently the member was provided with a uniform exposure, resulting in the formation of an electrostatic latent image which has a potential at the dark area −450 V, a potential at the bright area +100 V and a contrast voltage 550 V. The latent image was developed with a magnetic brush method with a good image picture of less photographic fog.

Furthermore, an experiment was conducted under the surroundings of temperature 25° C. and humidity 85% applying a similar process to a similar electrophotographic photosensitive member, resulting in that an image picture was similarly obtained with a picture quality of uniform and high density and with less photographic fog at the bright area.

What is claimed is:

1. An electrophotographic process which employs an electrophotographic photosensitive member of a basic construction in which a photoconductive layer and a transparent insulator layer are sequentially laminated on the surface of a conductive supporter, comprising the steps of:

providing a primary charge uniformly from the surface side of said transparent insulator layer of said photosensitive member;

performing a secondary corona charging during an imagewise exposure by applying a square wave voltage whose voltage-time integration value of a polarity reverse to said primary charge is greater than that of the same polarity as said primary charge; and forming an electrostatic latent image on said transparent insulator layer by applying a uniform exposure.

2. An electrophotographic process according to claim 1, in which said square wave voltage has a wave form whose positive and negative amplitudes are equal and whose energization period of a polarity reverse to said primary charge is longer than that of the same polarity thereas.

3. An electrophotographic process according to claim 1, in which said square wave voltage has a wave form whose positive and negative energization periods are equal and whose amplitude of a polarity reverse to said primary charge is larger than that of the same polarity thereas.

4. An electrophotographic process according to claim 1, in which said square wave voltage has a wave form whose amplitude of a polarity reverse to said primary charge is larger than that of the same polarity thereas and whose energization period of a polarity reverse to said primary charge is longer than that of the same polarity thereas.

5. Apparatus for use in an electrophotographic copier comprising:

photoconductor means for producing a latent image representative of an original being copied;

first means for creating a uniform charge on the surface of said photoconductor means;

second means for charging the surface of said photoconductor means in an alternating polarity fashion as the surface of said photoconductor means is exposed to light reflected from the original being copied;

third means for irradiating the surface of said photoconductor means;

said second means including means for generating a square wave voltage, such that the integrated value of one of the polarities of said square wave voltage is greater than the integrated value of the remaining polarity.

6. The electrophotographic apparatus of claim 5, wherein the polarity of the greater integrated value is opposite the polarity of the uniform charge level created on the surface of said photoconductor means by said first means.

7. The apparatus of claim 5, wherein said square wave generating means generates a square wave signal whose opposing polarity maximum amplitudes are unequal.

8. The apparatus of claim 5, wherein said square wave generating means generates a square wave signal whose opposing polarity signals are present for unequal time durations.

9. The apparatus of claim 5 wherein said square wave generating means generates a square wave signal whose opposing polarity maximum amplitudes are unequal and in which the time intervals of said opposing polarity signals are unequal.

10. An electrophotographic process which employs an electrophotographic photosensitive member of a basic construction in which a photoconductive layer and a transparent insulator layer are sequentially laminated on the surface of a conductive supporter, comprising the steps of:

providing a primary charge uniformly from the surface side of said transparent insulator layer of said photosensitive member;

performing a secondary corona during an imagewise exposure by applying a square wave voltage whose voltage-time integration value of a polarity reverse to said primary charge is greater than that of the same polarity as said primary charge; and forming an electrostatic latent image on said transparent insulator layer by applying a uniform exposure;

the square wave voltage applied having a frequency in the range of 50 to 1000 Hz and wherein the higher the copier reproduction rate, the higher the square wave frequency.

11. Apparatus for use in an electrophotographic copier comprising:

photoconductor means for producing a latent image representative of an original being copied;

first means for creating a uniform charge on the surface of said photoconductor means;

second means for charging the surface of said photoconductor means in a alternating polarity fashion as the surface of said photoconductor means is exposed to light reflected from the original being copied;

third means for irradiating the surface of said photoconductor means;

said second means including means for generating a square wave voltage, such that the integrated value of one of the polarities of said square wave voltage is greater than the integrated value of the remaining polarity;

the polarity of the greater integrated value of said square wave voltage being opposite the polarity of the uniform charge level created on the surface of said photoconductor means by said first means;

said second means generating a square wave signal in the range from 50 to 1000 Hz.

* * * * *

UNITED STATES PATENT AND TRADEMARK OFFICE

CERTIFICATE OF CORRECTION

PATENT NO. : 4,565,436

DATED : January 21, 1986

INVENTOR(S) : TAKAO OKADA, ET AL

It is certified that error appears in the above-identified patent and that said Letters Patent is hereby corrected as shown below:

Column 1, line 6, after "process" insert --and--;

Column 5, line 1, delete "the"; and

Column 9, line 7, (claim 10) after "corona" insert --charging--.

Signed and Sealed this

*Sixteenth* Day of *September 1986*

[SEAL]

*Attest:*

DONALD J. QUIGG

*Attesting Officer*

*Commissioner of Patents and Trademarks*